United States Patent [19]

Stock

[11] 4,254,574

[45] Mar. 10, 1981

[54] HOLLOW FORM, POLYHEDRON BLOCK ELEMENT FORMED OF SHEET MATERIAL

[76] Inventor: Robert Stock, 12311 Buaro, Garden Grove, Calif. 92640

[21] Appl. No.: 11,386

[22] Filed: Feb. 12, 1979

[51] Int. Cl.[3] ..... A63H 33/08; A63H 33/00

[52] U.S. Cl. ..... 46/25; 46/1 L

[58] Field of Search ..... 46/25, 1 L, 23, 24, 46/16, 17

[56] References Cited

U.S. PATENT DOCUMENTS

| | | | |
|---|---|---|---|
| 3,368,316 | 2/1968 | Crowder | 46/25 |
| 3,389,493 | 6/1968 | Zysset | 46/25 |
| 3,581,431 | 6/1971 | Trenovan | 46/1 L |
| 4,063,725 | 12/1977 | Snyder | 46/1 L |
| 4,079,540 | 3/1978 | Boyett et al. | 46/1 L |

*Primary Examiner*—Gene Mancene

*Assistant Examiner*—Michael J. Foycik, Jr.

*Attorney, Agent, or Firm*—Robert E. Strauss

[57] ABSTRACT

There is disclosed a hollow form building block useful for toys as a constructional block for play houses, forts, and the like, which is formed of inexpensive sheet material such as corrugated cardboard. The block element is a hollow-form, polyhedron that is provided with end walls, one of which has a polygonal aperture and the other of which has a coacting polygonal raised rim that is formed by folded tabs cut from the end wall and coacting tabs folded from an underlying end wall. The raised rim coacts with the apertures of other block elements to provide element-to-element interconnecting means and the raised rim also functions to secure the hollow-form block structure of the assembled, folded block element.

7 Claims, 8 Drawing Figures

HOLLOW FORM, POLYHEDRON BLOCK ELEMENT FORMED OF SHEET MATERIAL

BACKGROUND OF THE INVENTION

This invention relates to block elements useful as toys and, in particular, to an inexpensive block element formed of sheet material.

STATEMENT OF THE PRIOR ART

Hollow-form block elements have been provided with interconnecting means which coact between the block elements to provide element-to-element interconnection of the blocks in a single assembly. Examples of such are shown by U.S. Pat. Nos. 3,148,177 and 3,496,670. The aforementioned patents, however, do not disclose a construction that can be formed simply from sheet material and, in particular, do not disclose elements that can be formed from inexpensive material such as corrugated cardboard, sheet stock and the like.

There is a need for a hollow-form block element that can be simply and inexpensively manufactured and shipped to the user and that can be readily assembled into useable configurations by interconnection to like elements. Such assembly and construction should be sufficiently simple to permit a child to assemble and construct toy buildings such as play houses and the like. Additionally, the structure should be sufficiently strong to withstand abuse and resist collapsing to provide a permanent useful structure without hazard to children.

BRIEF STATEMENT OF THE INVENTION

This invention comprises a hollow-form polyhedron or block element which can be manufactured from inexpensive sheet material such as corrugated cardboard and the like. The block element is provided with interconnecting, element-to-element means to permit assembly of a plurality of block elements into a unitary structure such as a playhouse and the like. The interconnecting means comprises a polygonal aperture in one end wall of the block element and a coacting polygonal raised rim means of the same shape in the opposite and parallel end wall of the polyhedron block element. The rim means is formed by folded tabs cut from the opposite end wall, thereby forming a second polygonal aperture which receives coacting tab means folded from an underlying subwall. The coacting folded tab means function with the tabs folded from the aperture to form the raised rim means that can be received in corresponding polygonal apertures of adjacent block elements during the assembly of a plurality of elements into a single structure. The subwall is formed from folded ends of the side wall of the block and the folded tabs when received in the coacting polygonal aperture function to retain the assembly of the individual block element. This construction results in block elements which can be die cut from a single sheet material and which can be stored and shipped to the consumer in the folded configuration, yet can be readily constructed by children into the hollow form block elements having very high strength and dimensional stability, particularly when the block elements are assembled into unitary structures.

BRIEF STATEMENT OF THE DRAWINGS

The invention will be described with reference to the FIGURES of which:

DESCRIPTION OF PREFERRED EMBODIMENTS

Figure 1:
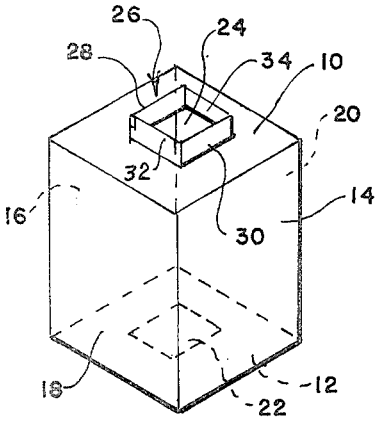
FIG. 1 illustrates a hexahedron according to the invention.

Referring now to FIG. 1, the modular block element of the invention is illustrated in a cubic form having a top wall 10, a bottom wall 12, front wall 14, back wall 16, and side walls 18 and 20. The block element is of hollow-form construction and is provided with block element-to-element interconnecting means in the form of a polygonal aperture 22 in bottom wall 12 and an equally shaped and spaced, polygonal raised rim 26 extending about polygonal aperture 24. The raised rim is formed by folded, first tabs 28 and 30 and second, coacting tabs 32 and 34.

Figure 3:
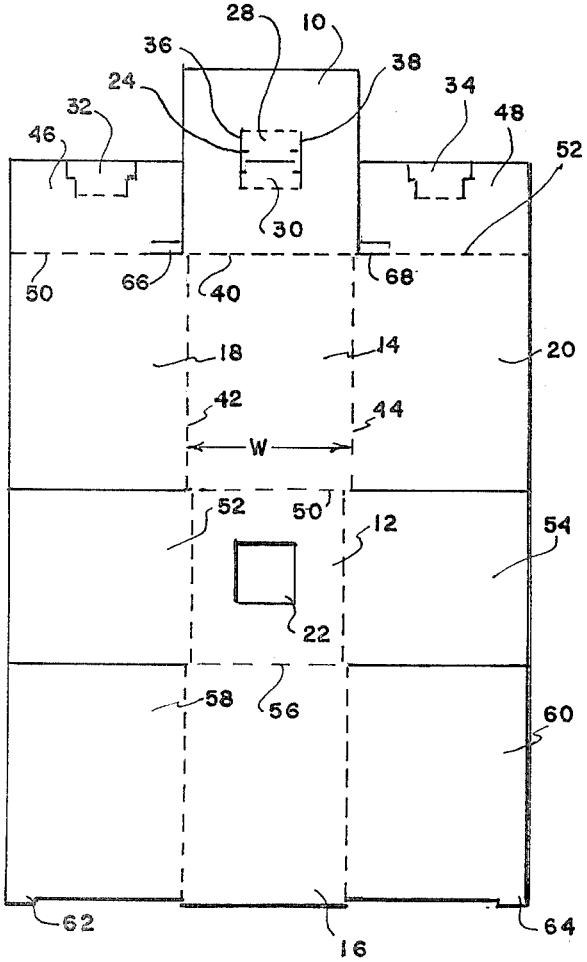
FIGS. 3 and 4 illustrate the construction of the hexahedron of FIG. 1.

Referring now to FIG. 3, the die cut pattern 34 from which the block element is formed is illustrated. This pattern is cut from a suitable constructional sheet material such as corrugated cardboard, however, other sheet materials which can be die cut and readily packaged and assembled by folding along the appropriate edges can also be employed. The pattern is formed with the top wall 10 having a die cut polygonal aperture 24 that is formed by the cutting of parallel slits 36 and 38 and a transverse slit therebetween to form the tabs 28 and 30. The front wall 14 has a common folded edge 40 with the top wall and is laterally contiguous with the two side walls 18 and 20, having common folded edges 42 and 44 with these side walls.

Each side wall has a contiguous top subwall 46 and 48 which have respective common folded edges 50 and 52 with their contiguous side walls. Each top subwall is of approximately ½ the width w of the block element such that these subwalls will meet along a common edge bisecting the aperture 24. Each top subwall is slit to form the second, coacting tabs 32 and 34.

The bottom wall 12 is contiguous with the front wall 14, sharing folded edge 50 and has lateral subwalls 52 and 54. The polygonal aperture 22 is die cut in the bottom wall, and preferably is centrally located therein, and of the same shape and spacing to be directly beneath the polygonal aperture 24 in the top wall when assembled as shown in FIG. 1.

The back wall 16 is contiguous with the bottom wall 12, sharing folded edge 56 therewith. The back wall 16 has lateral side subwalls 58 and 60 and each of the lateral subwalls has a finger prong 62 and 64. The top subwalls 46 and 48 bear slots 66 and 68 which are of the same width as the width of the respective prongs 62 and 64.

Figure 4:
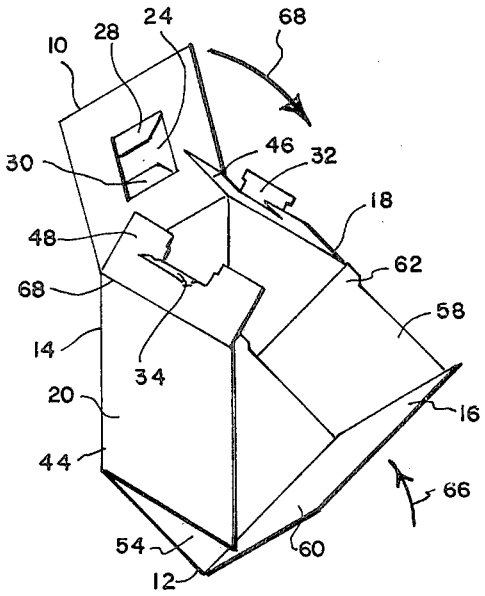

Referring now to FIG. 4, the simple assembly of the block element will be described. As illustrated, the block is rotated 180° from the view of FIG. 1 such that the front wall 14 appears in the back of the illustration. The pattern has been folded along edges 42 and 44 to move the side walls 18 and 20 into place and the top subwalls 46 and 48 have been also folded into approximately their final position. The bottom wall has been folded approximately into its final position and the lateral subwalls 52 and 54 have been folded and received between the side walls 18 and 20.

The back wall 16 is folded into position after the lateral side subwalls 62 and 64 have been folded and received between the sidewalls 18 and 20 and the back wall is then swung along the arrowhead line 66 to rotate this wall into place. During this placement, top subwalls 46 and 48 can be swung upward, out of the way, to permit passage of the side subwalls 58 and 60. When the side subwalls are moved into place, the prongs 62 and 64 will be received into interlocking slots 66 and 68. The top wall 10 is then moved along arrowhead line 68 and the coacting, folded tabs 32 and 34 of the top subwall are received within the aperture 24 of the top wall. These folded tabs are secured in the assembly between the first tabs 28 and 30 of the top wall.

Figure 2:
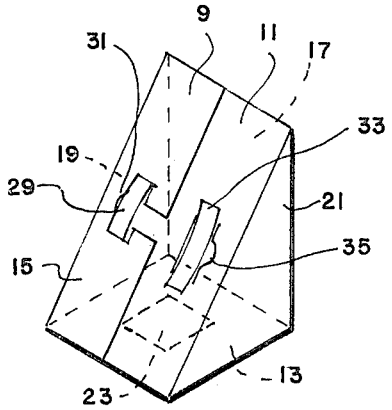
FIG. 2 illustrates a pentahedron according to the invention.

Referring now to FIG. 2, another embodiment of the invention will be described. This embodiment comprises a pent hedron having a bottom wall 13 with a polygonal aperture 23, triangular side walls 19 and 21, back wall 17 and inclined front wall 15. The front wall is formed by two folded half walls 9 and 11, and the assembly is retained by interconnecting means in the form of a T-shaped tab 29 that projects from half-wall 11 and is received in a coacting aperture 31 of the opposite half wall and a corresponding T-shaped tab 32 dependent on half wall 9 which is received in a coacting aperture 35 of the half wall 11.

Figure 5:
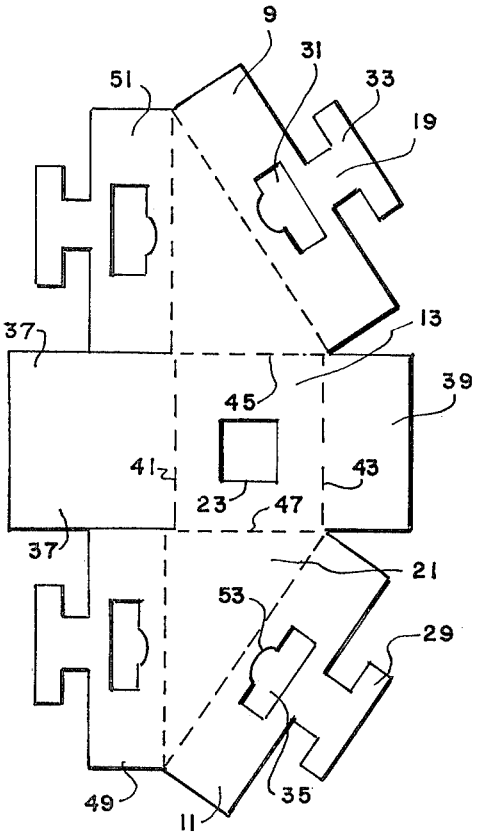
FIGS. 5 and 6 illustrate construction of the pentahedron of FIG. 2.

Referring now to FIG. 5, the pattern for the pentahedron block element of FIG. 2 will be described. As there illustrated, the bottom wall 13 has a die cut polygonal aperture 23 which is of the same dimensions and spacing with respect to the bottom wall as aperture 22 of bottom wall 12 of the block element shown in FIG. 1, whereby these block elements can be interchanged in the construction of buildings, forts and the like. The bottom wall is contiguous with the two side walls 19 and 21, having common folded edges 43 and 45 and is contiguous also with the back subwalls 37 and 39, sharing common folded edges 41 and 43 therewith.

Each of the side walls 19 and 21 are contiguous with back and front half walls; back half walls 49 and 51 and the previously mentioned front half walls 9 and 11.

The block assembly retaining means of the invention comprises the T-shaped tabs 29 and 33 and die cut slots 31 and 35. Preferably, each die cut slot has a central semi-circular cutout portion 53 to receive one's finger or a tool during the assembly of the block element.

Figure 6:
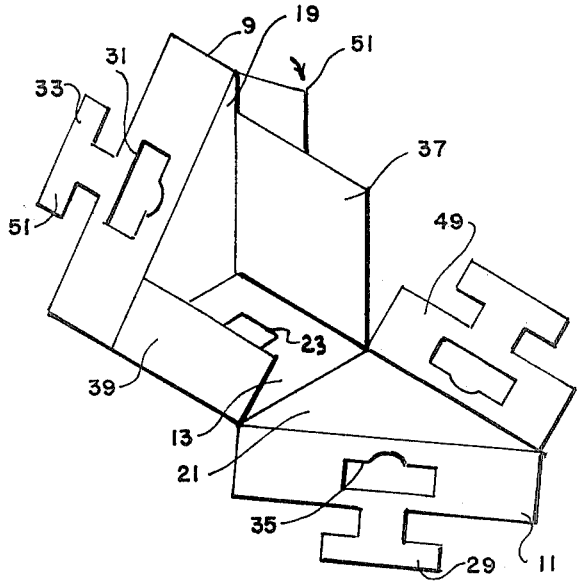

Referring now to FIG. 6, the assembly of the pentahedron block element is described. As there illustrated, the front and back subwalls 39 and 37 have been folded upright and the side wall 19 has also been folded into place. The back half wall 51 is being folded into place and a similar folding of the rear half wall 51 is to be made. The opposite side wall 21 is then folded in place, folding the contiguous front subwall 11 and rear subwall 49 and the final construction is completed by inserting the T-shaped tabs such as 29 and 33 into their respective slots such as 31 and 35.

Figure 7:
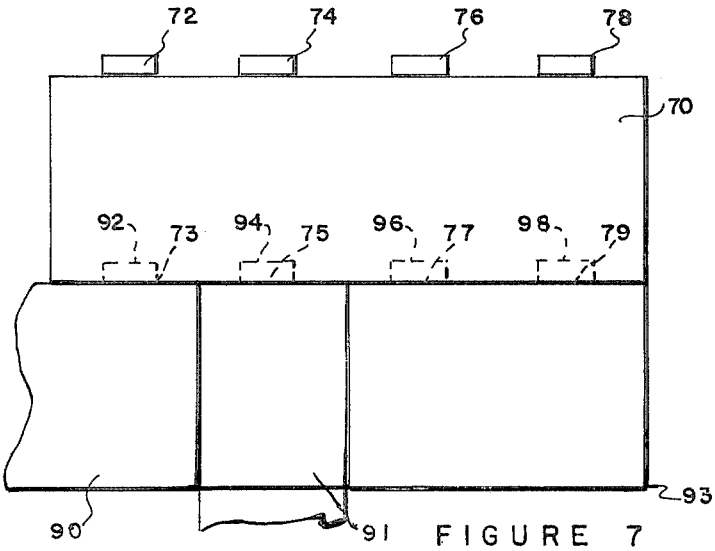
FIGS. 7 and 8 illustrate other shapes of useful hexahedrons.

The polyhedron hollow form block elements can be provided in a variety of shapes and sizes. FIG. 7 illustrates one modular construction which is the equivalent of four of the cubic block elements of FIG. 1, joined in a continuous length. As there illustrated, the polyhedron 70 has a plurality of polygonal apertures with the raised polygonal peripheral rims 72, 74, 76, and 78, and each of these is inline and opposite an equally shaped and similarly spaced polygonal aperture 73, 75, 77 and 79 in the opposite wall of the polyhedron. Each of these apertures receives a raised rim of subjacent blocks such as rim 92 of block 90, 94 of block 91, and rims 96 and 98 of block 93.

Figure 8:
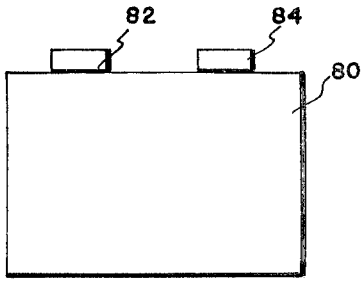

FIG. 8 shows a similar polyhedron 80 which has two of the polygonal apertures with raised rims 82 and 84 which are also opposite equally shaped and similarly spaced polygonal apertures.

The block elements of the invention can be readily stacked and the raised rim of the lower block element received within the polygonal aperture of the upper element. When so inserted, the block elements acquire a greater strength than when in their unconnected position, since the connecting of the blocked elements to coacting block elements enhances the securing of the tab means such as 32 and 34 which function as the block element retaining means.

The block elements can be supplied in the flat, unfolded configurations shown in FIGS. 2 and 5, and can be readily decorated in pleasing or vibrant colors to fascinate children. Since the block elements can be easily constructed without any tools, their assembly is literally child's play to provide durable and safe toys.

I claim:

1. A modular constructional block element formed from a foldable blank comprising a hollow-form polyhedron with a bottom wall having at least one centrally located polygonal aperture, back and front side walls, each foldably attached at one edge to an edge of said bottom wall and a full width top wall foldably attached at one edge to the upper edge of one of said back and front walls, a pair of side walls, each foldably attached at one edge to the edge of said front wall, a pair of half width top walls, each attached at one edge to the upper edge of a respective side wall and foldable to underlie said top wall, a first pair of foldable tabs centrally located in said top wall to form a second aperture therein and a second pair of foldable tabs, one each in one of said half width top walls located to be received in said second aperture of said full width top wall and to coact with said first pair of foldable tabs to form a raised rim about said second aperture whereby said polygonal aperture and second aperture with said raised rim define coacting, block interconnecting means and block element retention means.

2. The element of claim 1 also including a second pair of side walls, each foldably attached at one edge to the edge of said back wall and foldable to underlie said first pair of side walls.

3. The element of claim 2 wherein the edges of said folded half width top walls meet along a line intersecting the second aperture of said end wall.

4. A hollow-form pentahedron constructional block element having a bottom surface wall with a central polygonal aperture and a pair of triangular sidewalls, and formed from a foldable blank, each sidewall foldably attached at one edge to an edge of said bottom wall with continuous folded front and back half walls foldably attached at one edge thereof to an edge of said sidewalls with block element retention means comprising a T-shaped tab dependent from the outer edge of each of said half walls and cooperative receiving apertures therefor in the opposing half walls.

5. The element of claim 3 wherein said second coacting tabs comprise tabs cut and folded from said edges of said folded half width top walls.

6. The element of claim 5 wherein each of said second pair of side walls has a finger projection at its upper edge and each of said half width top walls has a coacting groove to receive a respective one of said finger projections.

7. The element of claim 6 including a third set of side walls, each foldably attached at one edge to an edge of said botton wall.

* * * * *